US005913380A

United States Patent [19]

Gugel et al.

[11] Patent Number: 5,913,380

[45] Date of Patent: Jun. 22, 1999

[54] LADDER ACCESSORY

[75] Inventors: Leslie H. Gugel; Joyce A. Gugel, both of Jupiter; Robert A. Marmesh; Albert Eng, both of Tequesta, all of Fla.

[73] Assignee: C-6 Corporation, Fla.

[21] Appl. No.: 08/914,114

[22] Filed: Aug. 19, 1997

Related U.S. Application Data

[63] Continuation-in-part of application No. 08/763,003, Dec. 10, 1996, which is a continuation-in-part of application No. 08/413,476, Mar. 30, 1995, Pat. No. 5,582,269.

[51] Int. Cl.[6] ..... E06C 7/14

[52] U.S. Cl. ..... 182/129; 248/210

[58] Field of Search ..... 182/129; 248/210, 248/238

[56] References Cited

U.S. PATENT DOCUMENTS 4,460,063 7/1984 Casada ..... 182/116
5,722,507 3/1998 Kain ..... 182/129
5,782,314 7/1998 Zeitler ..... 182/129

FOREIGN PATENT DOCUMENTS 2034795 6/1980 United Kingdom ..... 248/238

*Primary Examiner*—Alvin Chin-Shue
*Attorney, Agent, or Firm*—McHale & Slavin, PA

[57] ABSTRACT

The instant invention is a ladder accessory in the form of a toolbox. The toolbox is coupled to support brackets mounted on each front leg of a conventional ladder. The toolbox includes a handle that allows for securing to the brackets when the cover is opened by forcing pinions located in the bottom of the box through pinion apertures located on each support bracket. The support bracket allows lifting of the toolbox so as to provide a safe working area for a worker on top of the ladder allowing ease of access to the necessary tools in order to accomplish a particular task. Bracket release levers are provided on each support bracket to allow lifting of the toolbox in a convenient manner.

23 Claims, 18 Drawing Sheets

LADDER ACCESSORY

This is a continuation-in-part of Application having Ser. No. 08/763,003, filed Dec. 10, 1996, which is a continuation-in-part of application Ser. No. 08/413,476 filed Mar. 30, 1995, which issued Dec. 16, 1996, as U.S. Pat. No. 5,582,269.

FIELD OF THE INVENTION

This invention relates to ladders and more particularly to a removable ladder top accessory.

BACKGROUND OF THE INVENTION

Step ladders are used to perform tasks at an elevated stance. Conventional ladders are based on a collapsible A-frame structure having support rails that hold individual rungs allowing a person to climb up or down the structure so as to position themselves at various heights. The top portion includes a provision for pivoting the ladder support legs from a storage position wherein the legs are parallel to the A-frame stance.

While the primary intent of a ladder is to perform work at an elevated position, a problem arises from the lack of working space available to support tools. Although not the intended purpose, a top rung is commonly used to support working materials lessening the need to leave the ladder in order to obtain the necessary tools to perform a task. The top of the ladder may include holes or brackets for holding tools such as hammers, screw drivers and electric drills.

A paint tray platform may also be used to support items but is designed to support a conventional roller paint tray. Attempts to use the paint tray support platform for support of heavy items is dangerous. In light of the lack of surface area to support items needed while on a step ladder, prior art devices have been patented in an attempt to address the problem.

U.S. Pat. No. 5,123,620 discloses an accessory container for a ladder that mounts over the top of the ladder. The device is a single piece container that looks like a bucket and effectively provides an area for tools. The problem with the device is the necessity for removing the accessory when not in use, thus defeating the compactness of the conventional ladder.

U.S. Pat. No. 5,191,954 discloses a platform having support brackets that attach directly to the steps of a conventional aluminum ladder. The support structure relies upon the use of the hollow rungs that are spaced apart a predetermined distance so as to allow support of a back piece that also must be stored separately during storage.

U.S. Pat. No. 5,259,480 discloses an actual ladder top modified to accept various tools or hanging devices by use of a multi-function platform. Provisions are made for the device to replace the existing ladder top or attach directly to the existing ladder top.

U.S. Pat. No. 5,342,008 discloses yet another support platform that can be positioned anywhere along the longitudinal length of a ladder. This teaching requires a special shaped ladder having a handle area that extends above the top of the conventional A-frame support.

A problem with the prior art is that ladders have insufficient work area available for support of materials while working on the ladder. For these reasons it would be most beneficial to have a ladder with an accessory to support various working materials.

SUMMARY OF THE INVENTION

The instant invention is an accessory for a conventional ladder that operates as a utility or toolbox for holding various items in a stable position at the top of a ladder. The accessory replicates a conventional toolbox having a bin with four side walls. A cover to the bin includes a latch mechanism for securely holding any item placed in the bin. A handle is provided for transportation purposes. Unique to the toolbox is its ability to attach to a ladder in combination with brackets allowing the toolbox to be elevated over the top of the ladder.

The brackets consist of parallel disposed legs attached to each side surface of a ladder. A release lever includes a provision to allow the raising or lowering of the brackets to match the preferred operating height of a person standing on the ladder. The brackets accept the toolboxes of the instant invention which have pinions to engage each bracket. The pinions secure the toolbox between the brackets when the cover of the toolbox is open. The pinions are spring biased and positioned along each corner of the toolbox.

In operation, a worker may use the toolbox in its conventional manner. When a ladder is needed to work at an elevated height the worker places the toolbox on the top rung of the ladder having the aforementioned brackets. The cover latch is released and the cover opened therein allowing the pinions to project outwardly from the toolbox into pinion receptacles on each bracket. With the toolbox secured to the brackets, the worker may climb the ladder and raise the toolbox by lifting the brackets by grasping the handle on each bracket allowing for the slidable extension above the surface of the ladder.

Yet another embodiment of the invention is a ladder top accessory that universally adapts to all step ladders. The ladder accessory of the instant invention provides a device that straps to the top of a ladder providing an enlarged secure working surface. Integral storage pockets and tool apertures hold various tools adjacent to the work space. The work space further secures storage containers such as tool boxes, storage trays, disposable work trays, and so forth.

The device operates as a cap structure having additional functions including the use of hooks formed integral along a rear surface that can be used for storing cords and rags. A paper towel roll is conveniently stored beneath the cap structure with a slot formed through the structure for dispensing of the towels.

An objective of the instant invention is to provide a universally adaptable structure capable of fitting on any style or size step ladder that can be easily installed and removed without tools. Still another object of the instant invention is to teach a structure having an enlarged work surface with storage pockets and a toolholder that allows for additional storage containers and like accessories to be securely coupled to the structure for usage.

Still another object of the instant invention is to teach a cap structure for use of both left and right hand individuals that is durable and aesthetically pleasing.

Yet another object of the instant invention is to teach a cap structure having an integral ruler, storage pockets, toolholder, paper towel dispenser, enlarged tray working surface and attachment hooks. Yet still another object of the instant invention is to teach a structure that will accommodate a standard 9 inch metal pan for a paint roller providing for the perpendicular positioning of a roller brush, which allows ease of access to the handle.

Another object of the instant invention is to provide disposable painting modules that allow for holding of various size paint cans and paint brushes.

Thus, an objective of the instant invention is to disclose an adjustable utility box for placement on top of a conventional ladder wherein the box may accommodate articles being raised to various heights providing operator safety and convenience.

Still another objective of the instant invention is to disclose a toolbox that may be used in a conventional manner and engages brackets upon the lifting of the cover to secure the toolbox to the ladder.

Yet still another objective of the instant invention is to disclose a bracket kit for attachment to a ladder providing a raisable device for holding items therebetween.

Yet still another objective of the instant invention is to disclose a toolbox having a multi-purpose cover that further operates as a horizontal tray for positioning of items therein.

A further objective of the present invention is to disclose a toolbox or utility accessory case with a first bin compartment which is covered and latchably sealed via a hinged bin cover, and which additionally includes a lower tray detachably incorporated underneath;

Still another objective of the present invention is to disclose a toolbox or utility accessory case with has adjustable, releasable bracket mechanisms for slidably attaching a pair of support legs to the toolbox and a similar set of brackets for slidably attaching the support legs to the ladder, wherein the legs slide upwards and downwards for elevation control of the toolbox, and/or the toolbox slides upward and downwards for elevation control of the toolbox above the ladder.

Yet another objective of the present invention is to disclose a toolbox with a hingably attached bin cover which includes a recessed compartment in the upper surface of the bin cover, and with the compartment subdivided into subcompartments as needed.

A related objective of the present invention is to disclose a toolbox with a detachable panel for covering the recessed compartment, with the upper surface of the panel including raised concentric circles for accommodating a paint can.

Still another objective of the present invention is to disclose a toolbox with a cantilevered shelves extending from the sides of the outer surface of the bin, the shelves having assorted through holes for accomodating placement and storage of a variety of different shaped tools.

Still another objective of the present invention is to disclose a toolbox with brackets which provide for pushbutton, or push-tab, elevation adjustment of the toolbox above the support ladder surface.

Other objectives and advantages of this invention will become apparent from the following description taken in conjunction with the accompanying drawings wherein are set forth by way of illustration and example certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention is to be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
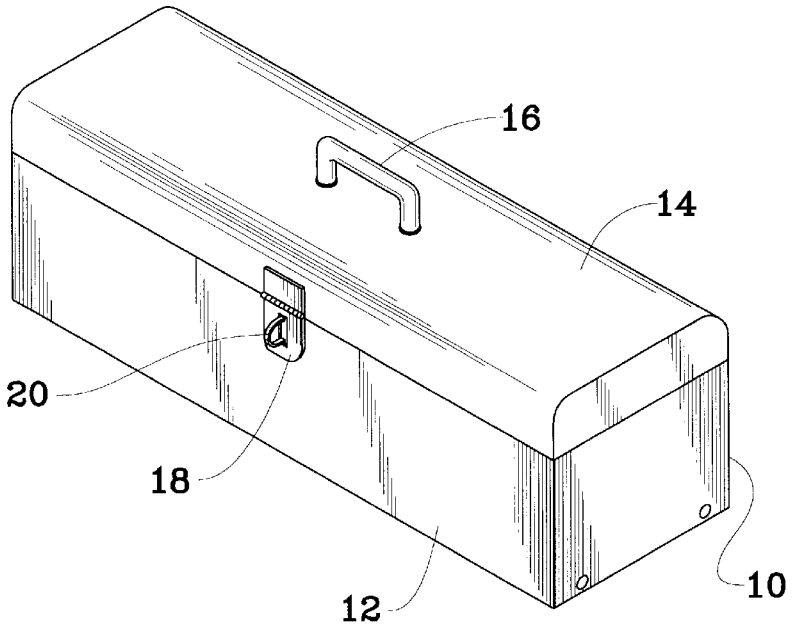
FIG. 1 is a perspective view of the toolbox.

Now referring to FIG. 1, shown is a toolbox 10 having a bin 12 and cover 14. Handle 16 is attached to the cover allowing the toolbox 10 to be carried. Hasp 18 attached to the cover for placement over hook 20 maintains the cover in a closed position when the toolbox is moved. A lock may be placed between the hook 20 and the hasp 18 to prevent access to the contents of the toolbox. It should be noted that the style of box is not critical to this invention which is directed to the idea of elevating a toolbox above the surface of a ladder.

Figure 2:
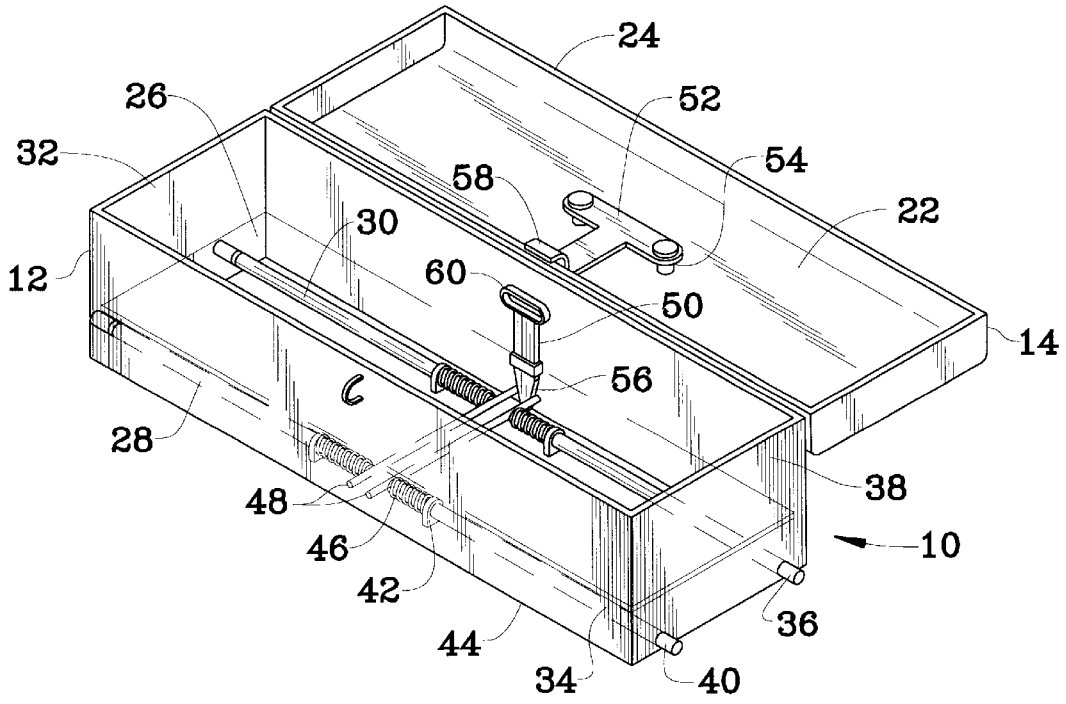
FIG. 2 is a perspective view of FIG. 1 illustrating the toolbox in an open position and the latching mechanism incorporated therein.

Referring to FIG. 2 the toolbox 10 is shown with cover 14 placed in an open position. The cover has an inner surface area 22 which is positioned in a horizontal plane parallel to a bin 12 of the toolbox 10 providing a tray area allowing items to be placed thereon. Side wall 24 prevents the items from sliding off. The toolbox includes a bottom plate 26 which conceals a locking mechanism consisting of pinions 28 and 30 which extend through a side surface 32 of the box with pinions 34 and 36 extending through a second side surface 38. The pinions are redundant in operation as shown by pinion 34 which extends through aperture 40 of side surface 38 having internal surface support 42 maintaining the pinion 34 a fixed distance from bottom surface 44 allowing spring 46 to move freely along one end of the pinion 34. Parallel disposed separating rods 48 are operated by lever 50 which engages an inner support 52 for the handle which is biased a raised distance from surface 22 by springs 54. When the cover is in an open position the lever 50 has an angular base 56 which engages an inner surface of separating rods 48 biasing pinions 28, 30, 34, and 36 in an outward position as shown by 34. The pinions operate similarly and detail is not repeated for the remaining pinions to maintain clarity to the drawing.

When the cover 14 is placed in a closed position latch 58 engages lever opening 60. Lifting of handle 16 causes inner support 52 to be compressed against springs 54 which in turn causes latch 58 to be raised, now coupled to opening 60, lifting lever 50. Angular portion 56 is drawn between the two separating rods 48 with spring 46 biasing against support 42 forcing pinion 34 inwardly from aperture 40 thereby disengaging the toolbox from support brackets and allowing the toolbox to be moved accordingly.

Figure 3:
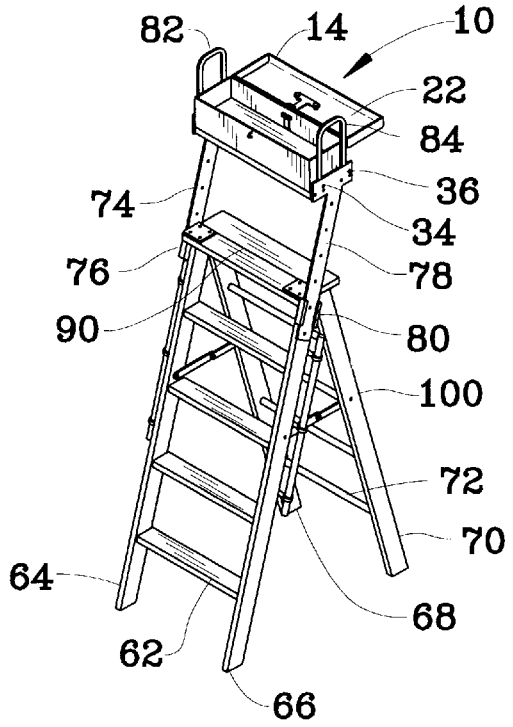
FIG. 3 is a perspective view of a ladder having the toolbox attached to the bracketry of the ladder.

As shown in FIG. 3, ladder 100 includes step rung 62 with spaced apart front ladder legs 64 and 66. The ladder 100 is a conventional A-structure frame having a rear support provided by legs 68 and 70 separated by rungs 72. As described later in this specification, brackets 74 are attached to ladder leg 64 by coupling bracket 76 with a mirror image bracket 78 coupled to ladder leg 66 by bracket 80. Bracket 74 and 78 include handles 82 and 84 respectively. The support bracket provides a means for raising the brackets by grasping handles 82 and 84 having a release mechanism, not shown, which simply allows the handles 82 and 84 to be raised simultaneously by releasing an engagement tab which locks the brackets. Toolbox 10 is shown in a raised position with cover 14 in an open position, pinions 34 and 36 extend through bracket 78 securing the toolbox 10 to the bracket.

By way of operation, bracket 74 and 78 are lowered to a preset position adjacent upper surface 90. Toolbox 10 can be carried to the ladder and placed upon upper surface 90. The handle is folded and cover 14 is unlatched from hasp and opened which compresses the springs causing the pinions to be driven outward through the side surfaces of the toolbox so as to engage receptive apertures located on brackets 74 and 78. An operator may then climb the rungs 72 of the ladder and by grasping handles 82 and 84, raise the toolbox to a comfortable position. It is noted that brackets 74 and 78 are set at the same angular direction as ladder legs 64 and 66 which provides the operator sufficient area so as to use the ladder in a conventional manner, yet provide a raised support for access to tools. As previously mentioned, surface 22 of the toolbox is maintained in a flat horizontal position allowing the operator additional surface area in which to place various items.

Figure 4:
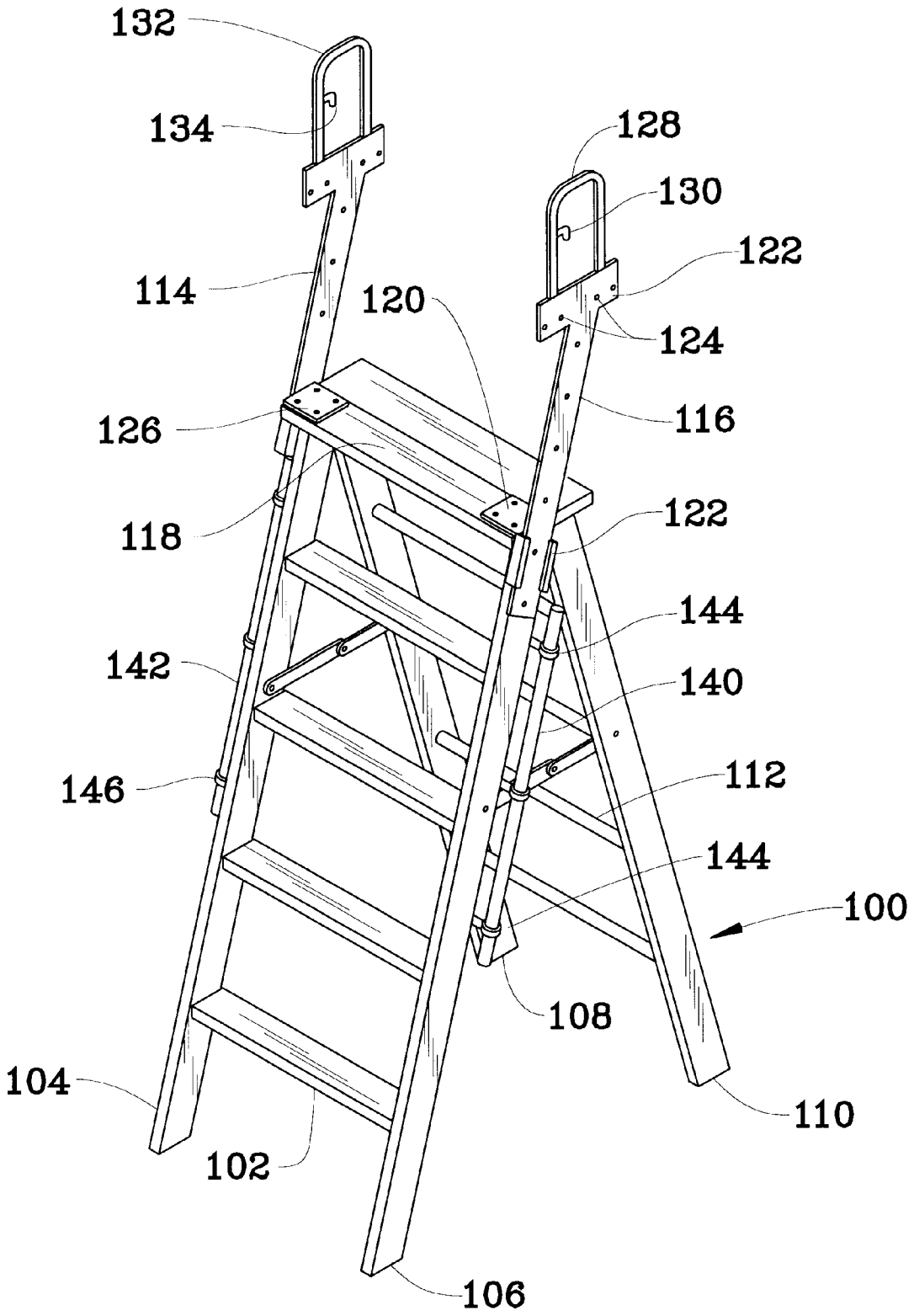
FIG. 4 is a perspective view of the ladder illustrating the bracket kit of the instant invention.

Referring to FIG. 4, shown is a conventional ladder 100 having step rungs 102 spaced apart with ladder legs 104 and 106. The ladder 100 is a conventional A-structure frame having a rear support provided by legs 108 and 110 separated by horizontal support structures 112. Support brackets 114 and 116 are used to support the toolbox of the instant invention over the upper surface 118 of the ladder 100. Bracket 116 is coupled to the upper surface 118 and ladder leg 106 by angle bracket 120 having a first horizontal portion for attachment to the upper surface 118 and is secured to the platform by a plurality of fasteners such as wood screws. Support bracket 122 is secured in a parallel position to ladder leg 106 having formed a cradle for the slidable insertion of bracket 116. An upper portion of the support bracket 122 includes through holes 124 for insertion of pinions from the toolbox. Similarly, bracket 114 is mounted to the ladder by support 126 which is coupled to the upper surface 118 and outside of ladder leg 104 in a similar manner as bracket 120 by use of fasteners such as wood screws. The top portion of bracket 116 includes a handle 128 which allows for ease of grasping the bracket for purposes of lifting and lowering the bracket and associated toolbox as necessary. Release latch 130 operates in conjunction with bracket 120 to allow the slidable insertion of bracket portion 116 through channel 122. Similarly, the second bracket 114 includes handle 132 with release lever 134 allowing for the raising and lowering of bracket 114 in a horizontal position allowing for the raising and lowering of the toolbox while maintaining the toolbox in a horizontal plane in respect to upper surface 118. It should be noted that bracket 116 cannot be raised higher than bracket 114 when a toolbox is placed therebetween as the toolbox would cause one bracket to crimp within its respective support channel thereby requiring the brackets to be lowered and raised simultaneously. To further assist a worker side rails 140 and 142 are coupled to each front leg by use of support brackets 144 and 146.

Figure 5:
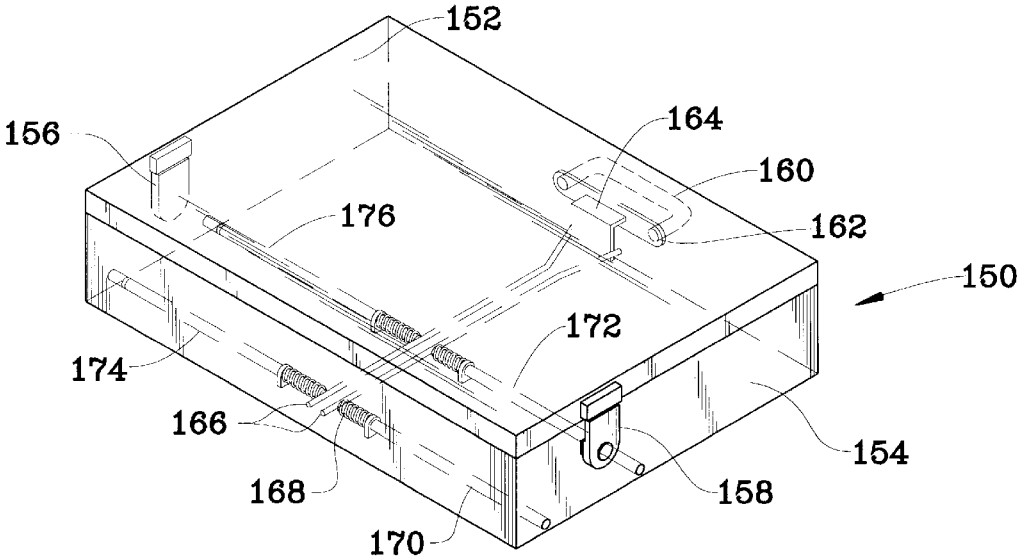
FIG. 5 is a perspective view of a compartmentalized toolbox illustrating the locking mechanism.

Now referring to FIG. 5, shown is an alternative embodiment of the instant invention defining a multi-compartment box. The compartment box 150 has a cover 152 situated over a bin 154. Hasps 156 and 158 operate as hasps to maintain the cover in a closed position. Handle 160 is used to carry the box 150 in the ordinary and conventional manner. When the handle 160 is turned sideways it will depress springs 162 causing engagement plate 164 to be moved outwardly along spacer bars 166 causing springs 168 as on pinion 170 to push outward through side wall of bin 154. Pinions 172, 174 and 176 operate in a similar manner, each having their own springs biased from separated spacer bars 166. When the cover is closed pinions 170, 172, 174, and 176 are retracted allowing the box 150 to be removed from the ladder. Hasps 156 and 158 are located on each side surface allowing the box to be placed on its end in the form of an attache case.

Figure 6:
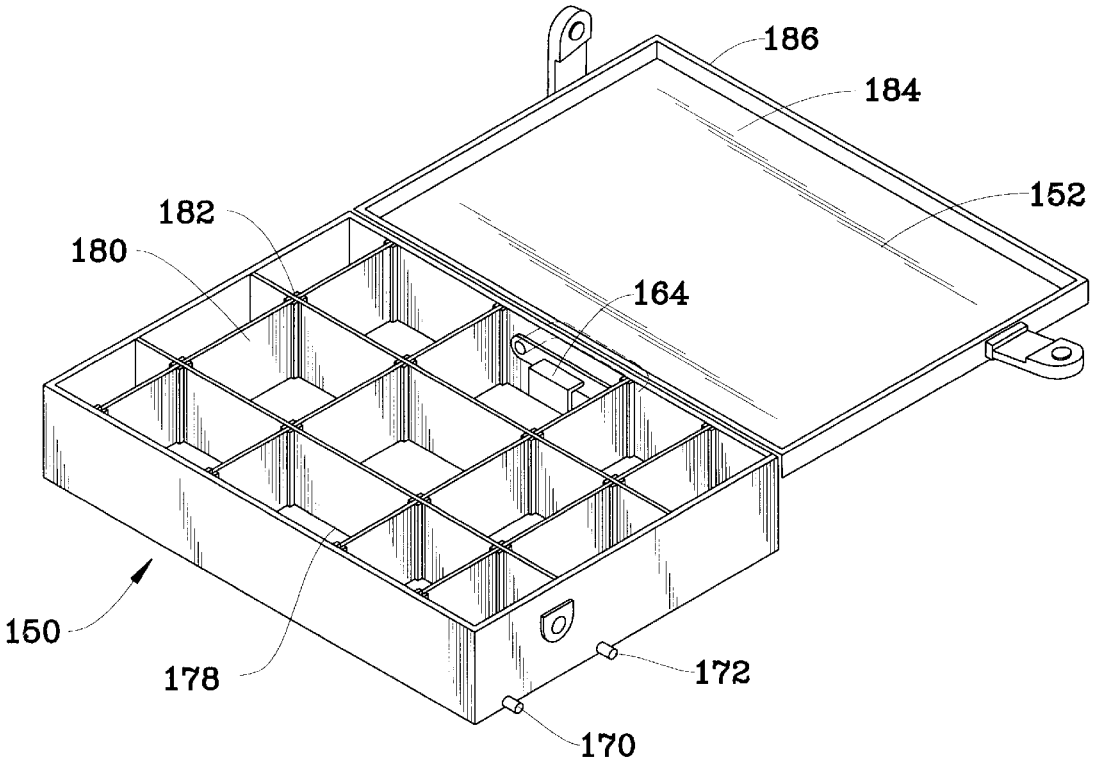
FIG. 6 is a perspective view of the compartmentalized toolbox set forth in FIG. 5 placed in an open position.
Figure 8:
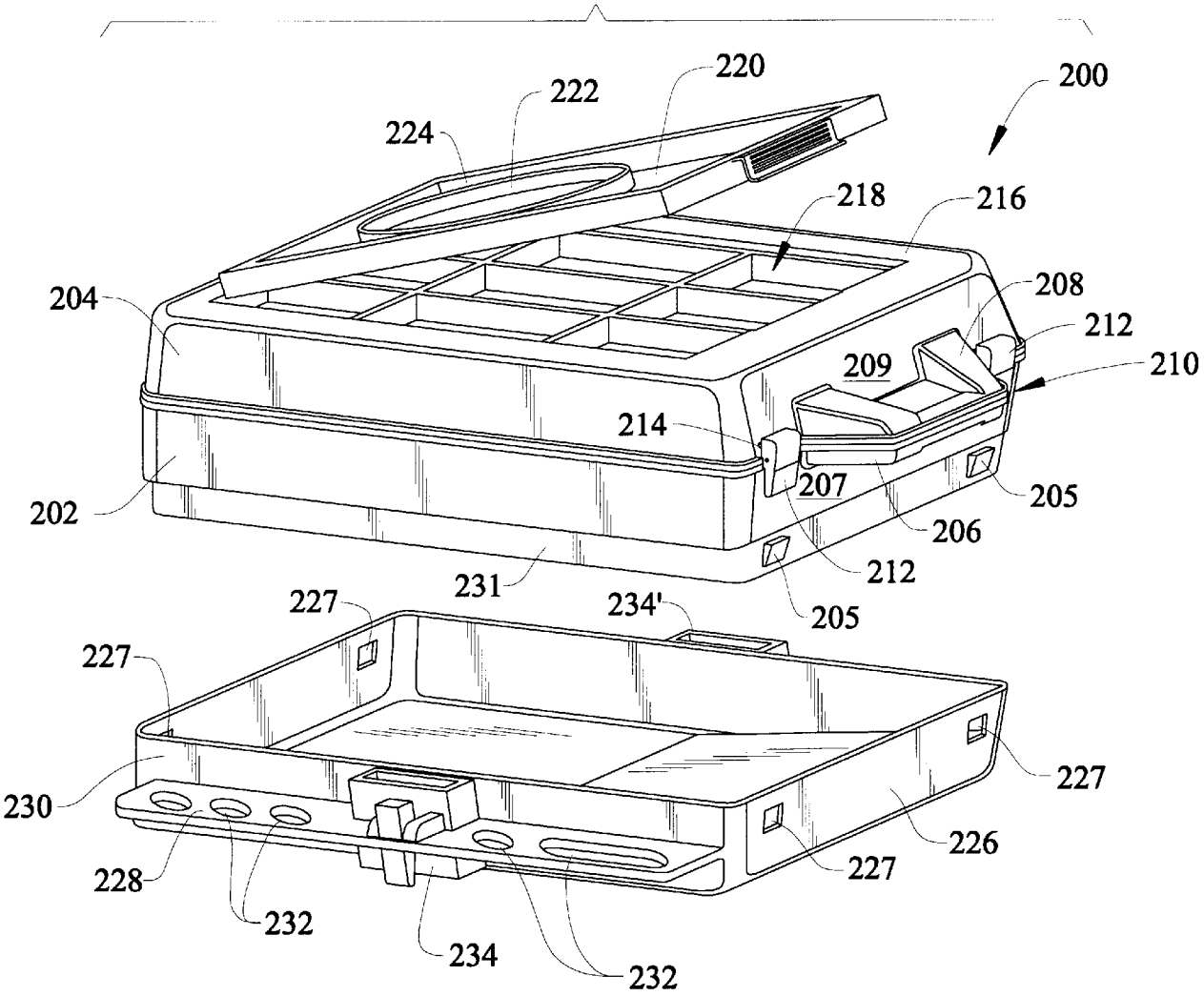
FIG. 8 is a perspective view of an embodied toolbox or utility case with the upper panel raised to show the recessed compartments in the upper surface of the hingably attached bin cover, and the lower tray releasably detached from the lower surface of the toolbox bin.
Figure 9:
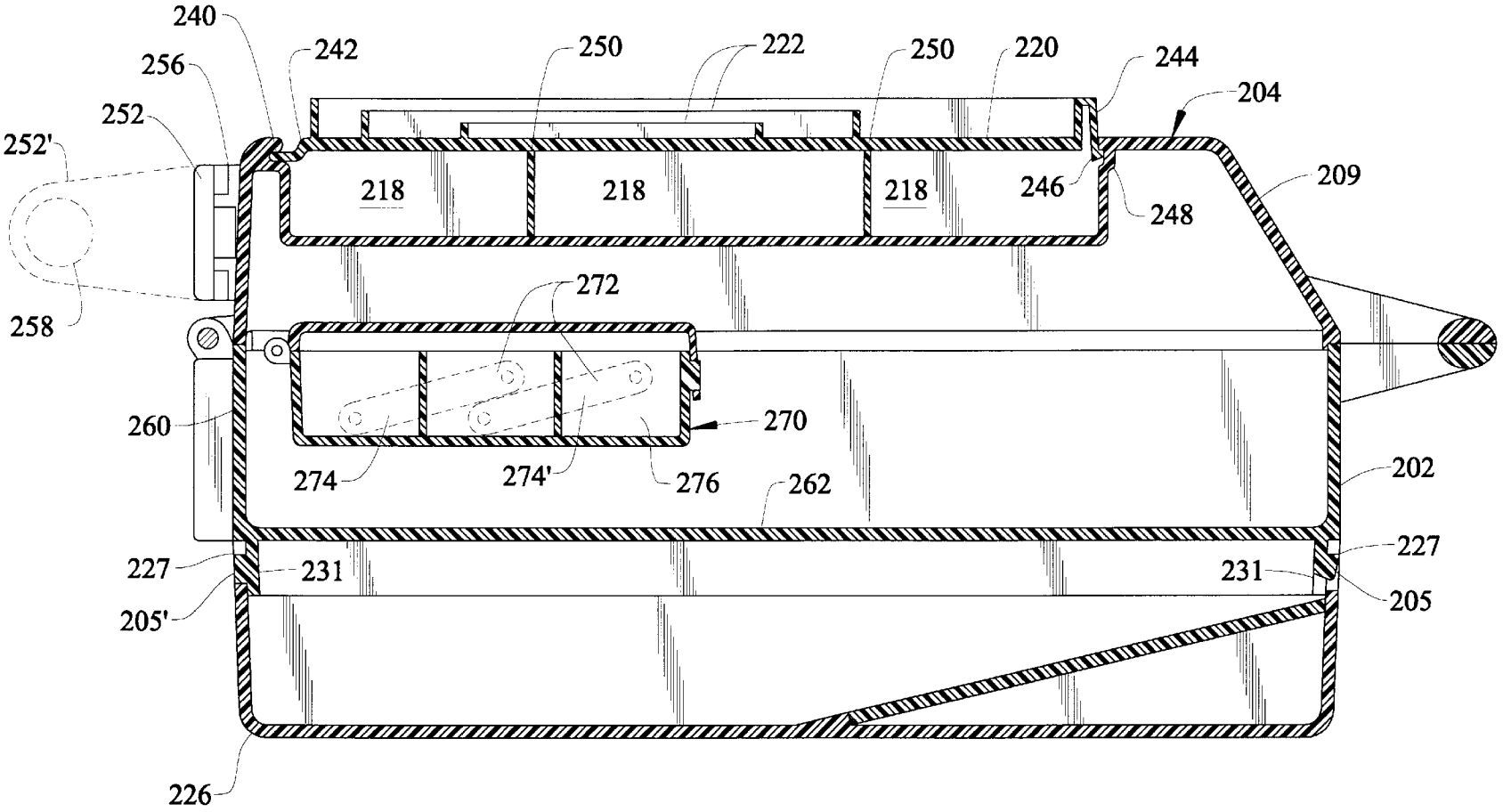
FIG. 9 is a cutaway view of the toolbox of FIG. 11 along cut 9—9.
Figure 10:
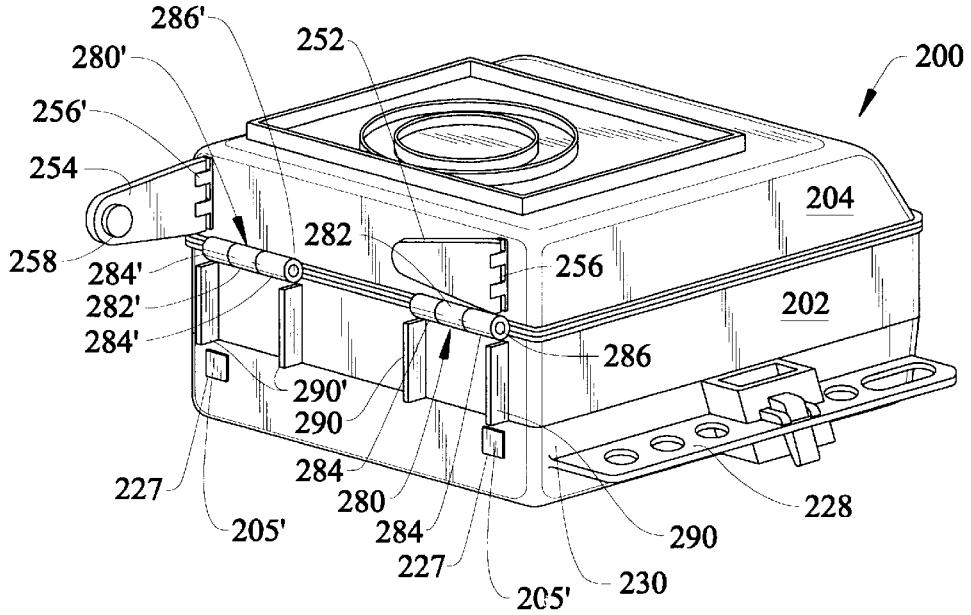
FIG. 10 is a perspective view of the back of the toolbox of FIG. 8 showing the feet extensions and the core mounting arms.

Referring to FIG. 6, the box 150 is shown with the cover 152 in an open position revealing inner surface 184 defined by side wall 186. A plurality of compartments 178 are set further in the bin and can be adjusted in size by movement of individual spacer plates 180 which fit into union connectors 182. In the open position, engagement plate 164 is allowed to move inwardly wherein spacer bars 166, as shown in FIG. 5, are inserted allowing the pinions to project outwardly as provided by their respective biasing springs.

Figure 7:
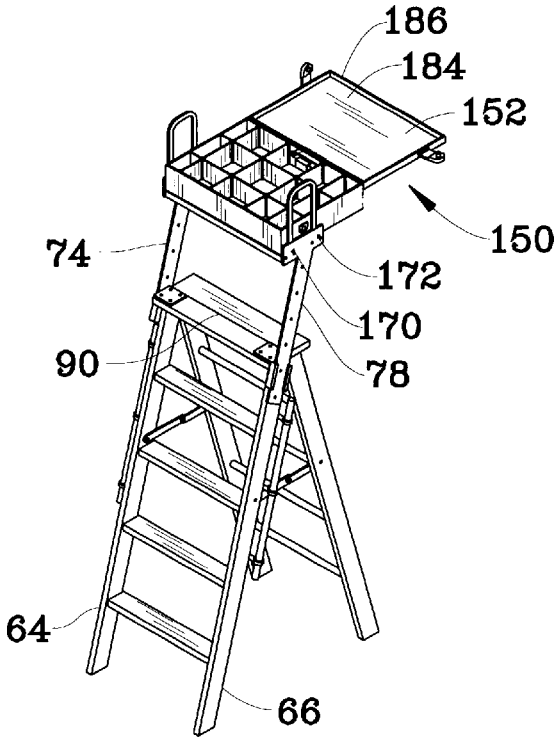
FIG. 7 is a perspective view of a ladder having the bracketry with the compartmentalized toolbox secured.

Referring to FIG. 7, set forth is a conventional A-framed ladder as previously described having brackets 74 and 78 coupled to each front ladder leg 64 and 66. Box 150 is attached to the brackets in a raised position wherein pinions 170 and 172 are inserted through bracket apertures allowing for the support of the box in a raised position a distance above upper surface 90 for the convenience and safety of the operator. Cover 152 has surface 184 which is maintained in a horizontal plane in relation to the lower portion of the box with a raised lip 186 provided around the peripheral of the surface 184 allowing additional surface area for placement of items which are prevented from rolling off the surface by the raised lip 186. As previously described, box 150 is installed by placement upon upper surface 90 while bracket 74 and 78 are in a lowered position. To prevent accidental dislodgment, the handle 160 is set at the rear of the box, as shown, preventing the worker from removing the box while on the ladder. It is my desire to require the box to be lowered to the upper surface 90 wherein the operator would walk to the rear of the ladder for rotation of the handle to a position that will retract pinion bars from their respective engagement to brackets 74 and 78.

Figure 18:
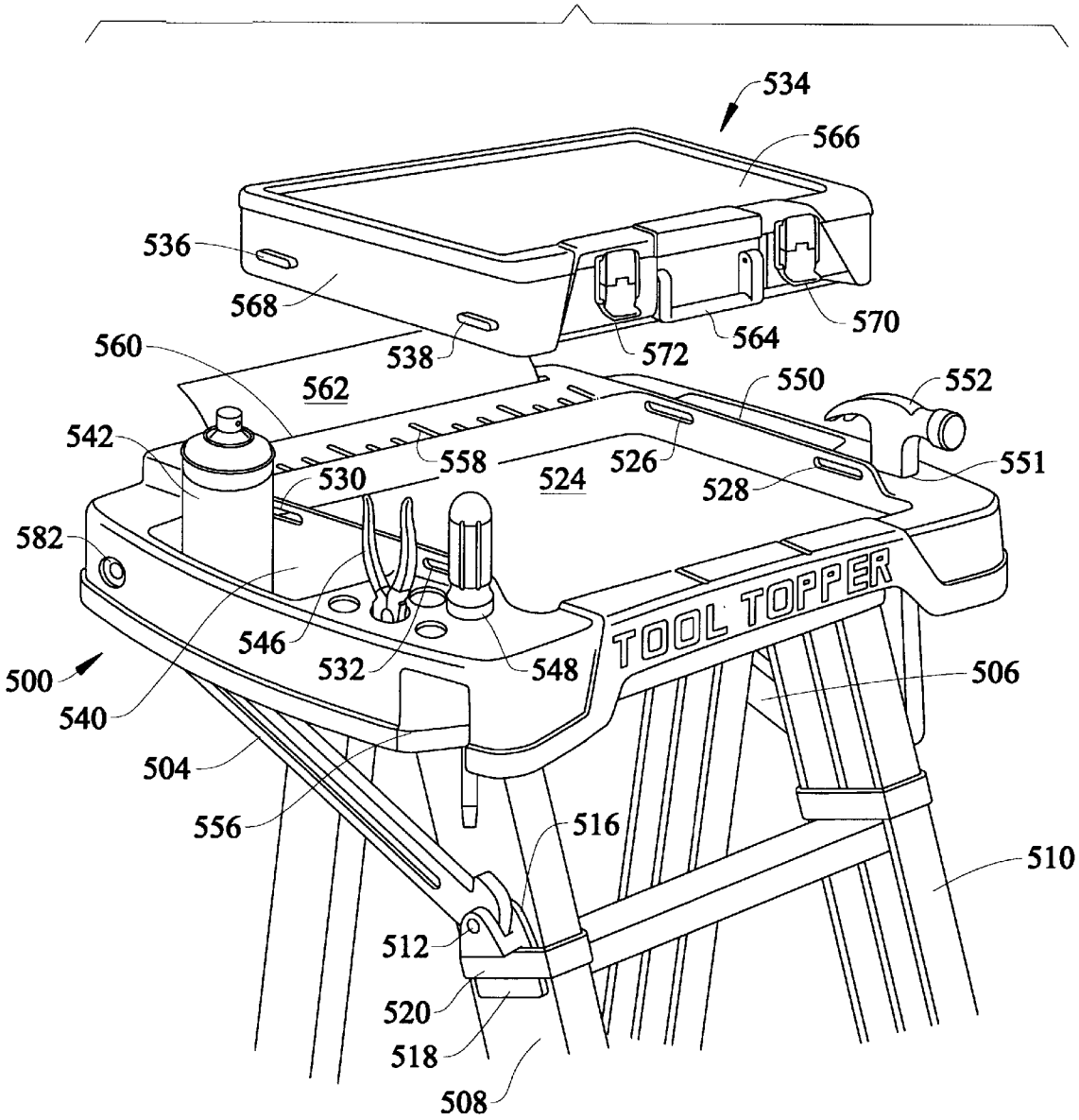
FIG. 18 is a pictorial view of another embodiment of the invention having a Cap structure the detachable toolbox.

Referring now to FIG. 18, set forth is yet another embodiment of the instant invention. Ladder cap structure 500 is positioned along the uppermost portion of a ladder 502 and securely fastened thereto by struts 504 and 506, the struts are releasably secured to ladder support posts 508 and 510 respectively. Strut 504 has a first end 512 pivotally coupled to support bracket 514 having an upper portion 516 and a flat lower portion 518. The upper portion is shaped to receive an adjustable strap 520 for securing the support bracket, preferably the strap includes a hook and pile "Velcro" type attachment for securely holding the support structure in position. The upper portion 516 includes a pivot attachment 512 and is enlarged to form an engagement lip for positioning of the strap 520 in a position most advantageous to prevent movement of the support structure 514 in relation to the support post.

The proximal end 522 of strut 504 is pivotally coupled to the cap structure 500 allowing the structure to be adjustably secured to any size or style ladder. The cap structure 500 is formed from a single piece of plastic having an inner tray surface 524 with slots 526, 528, 530 and 532 located around the tray portion for use in coupling various storage containers to the structure. For instance, tool box 534 is illustrated as one such container having snap attachments 536 and 538 which engage slot openings 530 and 532 respectively. Snap numbers on an opposite side surface for engaging slots 526 and 528 (not shown) provide a secure attachment of the container to the cap structure.

The cap structure 500 includes storage indentation 540 sized for holding miscellaneous items such as the illustrated aerosol can 542, adjacent to the support surface. Apertures 544 allow for placement of miscellaneous items such as the illustrated pliers 546 and screwdriver 548. Storage indentation 550 provides yet another cavity for holding miscellaneous items, with enlarged slot 551 securing larger tools such as the depicted hammer 552. It should be noted that variations on the size and depth of the indentations, as well as aperture size and placement is deemed within the scope of this invention, the cap structure depicted is but a single embodiment of the type of cap structures that may be mounted on top of a ladder.

Hand holds 556 and 557 are formed integral to the cap structure along the front portion allowing an individual to grasp the structure for purposes of installing the structure, as well as for use in balancing an individual once the structure is securely installed. The cap structure 500 includes an integrated ruler 558 and a paper towel roll holder, the holder position to allow for the passage of paper towels through slot 560 set parallel to the ruler.

The illustrated toolbox 534 has an external dimensional size configured for placement within the working surface area which defines a tray area 524 boarded by side walls having securement slots. The toolbox includes a handle 564 for ease of movement, the cover 566 is hingedly attached and may be lifted upon release of hinges 570 and 572. The tray area allows for usage as a work surface as well as accommodates numerous style toolboxes, trays, and the like accessory attachments hereinafter commonly referred to storage containers.

Figure 19:
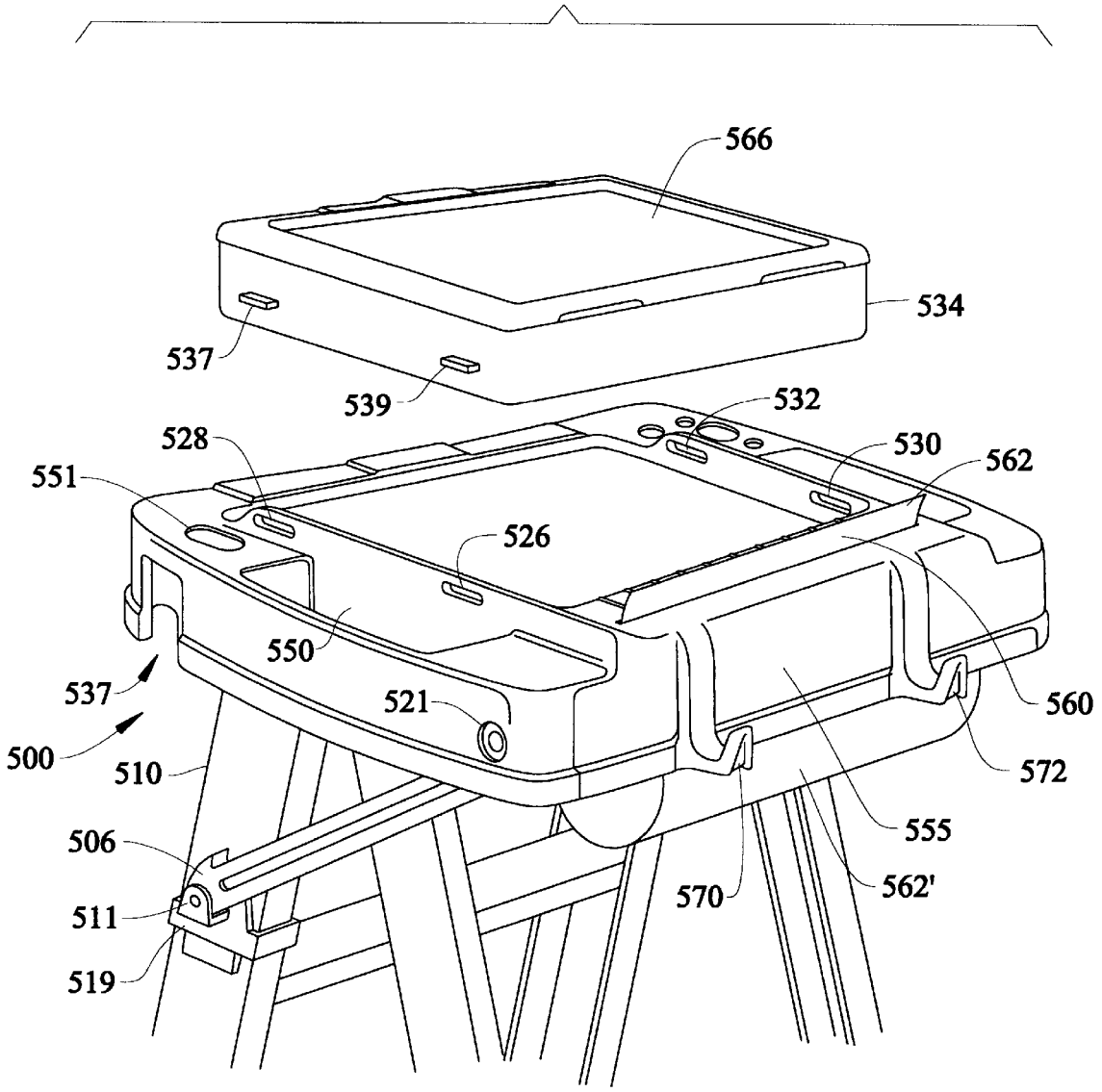
FIG. 19 is a rear partially exploded perspective view of FIG. 18.

Referring now to FIG. 19, the cap structure 500 illustrates the use of second strut 506 secured to opposite ladder front support post 510 again by use of a hook and pile strap 519 which wraps around support 510 and support structure 511. In the same manner struts 504 and 506 are pivotally secured to the rear portion 521 of the cap structure 500. Paper towel roll 562' is mounted beneath the structure 500 and spooled through slot 560 allowing a single sheet 562 to be grasped. The rear surface 555 further includes integral hooks 570 and 572 available for holding cord, power lines, rags, and so forth.

Hand hold 557, a mirror image of hand hold 556, is further illustrated through this rearward view. The hand hold has a depth that allows an individual to grasp the structure, yet inhibits an individual holding the cap structure as if a full support. It should be noted that each strut 504 and 506 has a 100 lb load bearing capacity.

Figure 20:
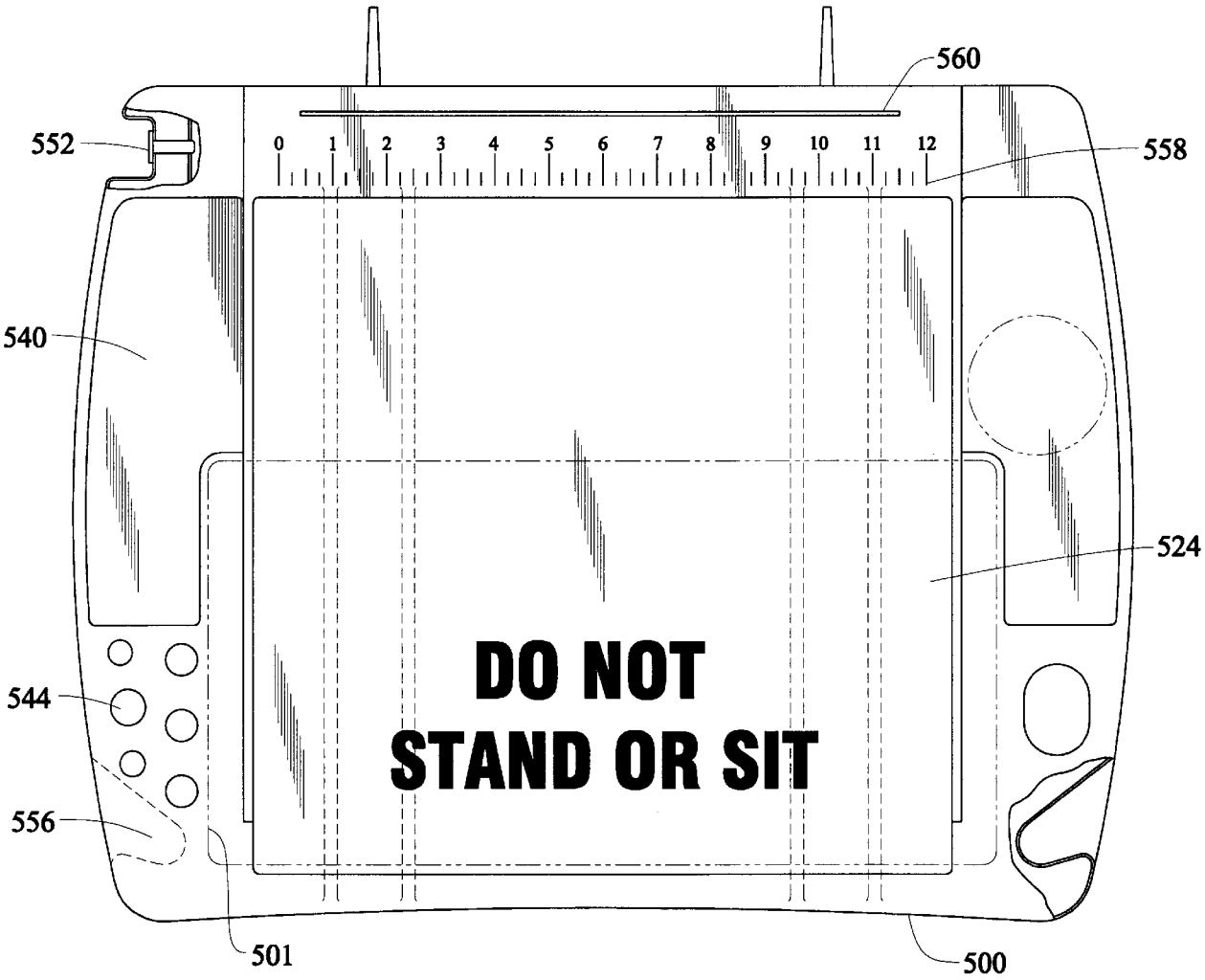
FIG. 20 is a cross sectional top view of the cap structure.

FIG. 20 is a top view of the cap structure 500, not to scale, illustrating the enlarged working surface 524 receptive for placement of tools as well as securement of tool boxes, accessories, and various other attachments as described later in this specification. The lower surface of the structure, shown by hidden lines 501, provides an area for positioning of the cap structure to the top support of a ladder. The curvature of hand holds 556 and 557 is shown which illustrates the cavity shape allowing for placement of an individual's fingers. Apertures 554 provide for placement of miscellaneous small tools such as screw drivers with a larger aperture 551 available for larger tools such as pliers and hammers. Storage compartments 540 and 550 provide general purpose containment areas for placement of temporary items such as spray bottles.

Figure 21:
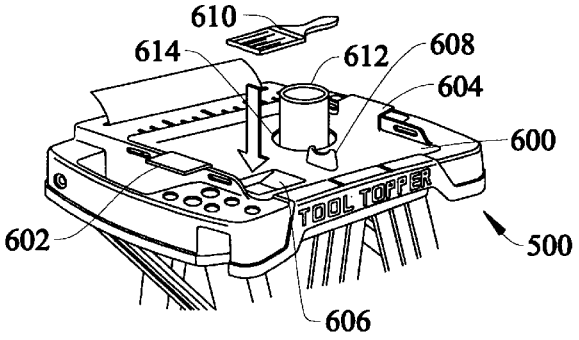
FIG. 21 is a pictorial view of the cap structure having a paint brush disposable tray.
Figure 22:
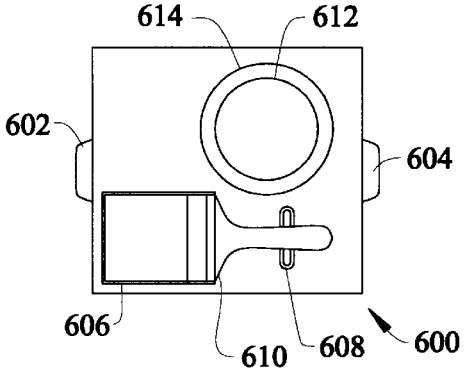
FIG. 22 is a top plain view of the tray.
Figure 23:
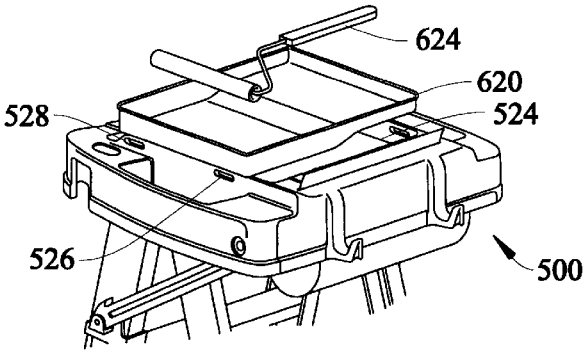
FIG. 23 is a perspective view of a paint roller tray secured to the cap structure.

Referring now to FIGS. 21 and 22, shown is the cap structure 500 with an example of an accessory tray 600 placed within the working surface. The tray 600 includes handles 602 and 604 for lifting of the tray. A depression 606 provides for positioning of a paint brush 610, with raised support 608 maintaining the handle of the paint brush in a raised position. A paint can 612 is shown illustrated within holder 614 allowing ease of access by a brush. The tray 600 is preferably formed from a low cost disposable plastic module, typically 0.050 thickness of vacuum formed plastic. FIG. 23 depicts the cap structure 500 having a conventional roller paint tray 620 placed onto the upper surface 524 with slots 528 and 526 available for engaging the L-shaped legs of the paint tray 620. Once the tray is secured, a paint brush roller 624 can be accessed in a perpendicular manner for ease of use.

Figure 24:
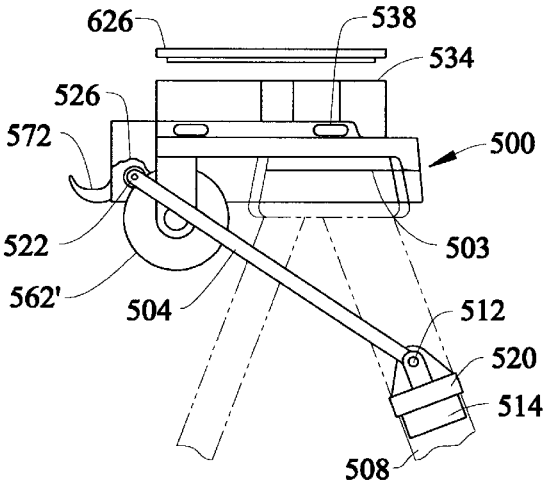
FIG. 24 is a cross sectional view of the cap structure with a toolbox.

Now referring to FIG. 24, set forth is a side view depicting the cap structure 500 secured to the upper portion 503 of a ladder, having side support 508. Strut 504 is secured to the side support 508 by the use of the hook and pile type strap 520 which allows for adjustable securement of the support bracket 514 along the length of the support post 508 through the use of pivotal coupling 512 and 522. Hook 572 is shown along the rear surface of the cap structure with paper towel roll 562' extending through a slot for delivery of individual paper sheets 562. Toolbox 534 is shown secured to the cap structure 500 by engagement tabs as generally depicted by numeral 538. This embodiment further depicts a low cost disposable paint module 626 which can be secured to the upper surface of the toolbox 534.

Figure 25:
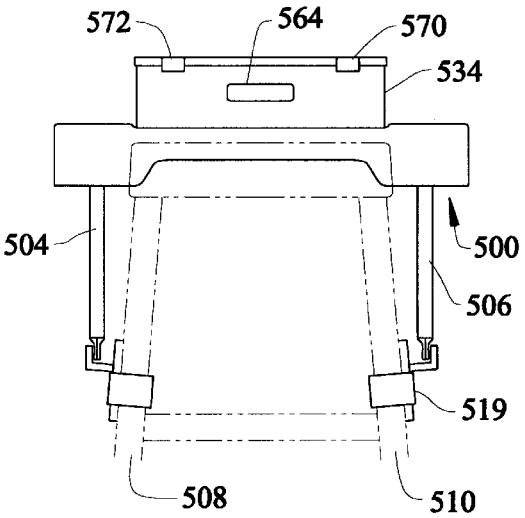
FIG. 25 is a front view of the cap structure with a toolbox attached.

FIG. 25 depicts a front view of the cap structure 500 secured to the ladder by use of struts 504 and 506 adjustably secured to support post 508 and 510 by hook and pile 520 and 519. Once secured, the toolbox 534 may be accessed by opening of latches 572 and 570. When the toolboxes are to be removed the latches are secured so the toolbox can be lifted by handle 564.

Figure 26:
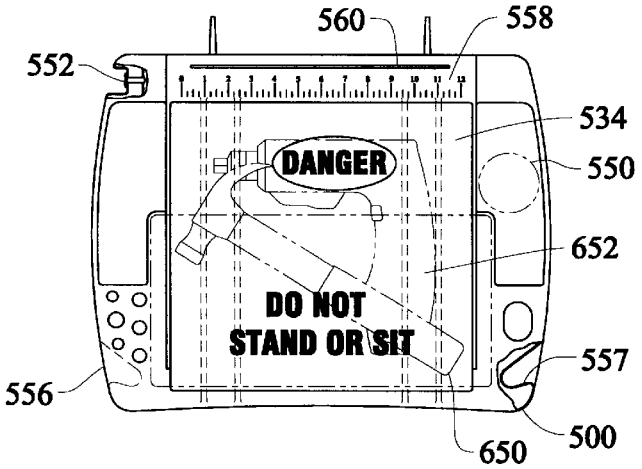
FIG. 26 is a cross sectional top view of the cap structure with an installed toolbox having tools installed within the box and placed thereon.

Now referring to FIG. 26 shown is a top view of the cap structure 500 which illustrates the size of the structure wherein placement of toolbox 534 has a hammer 650 placed within the case and a portable drill 652 placed on the flat portion above the tool case.

Figure 11:
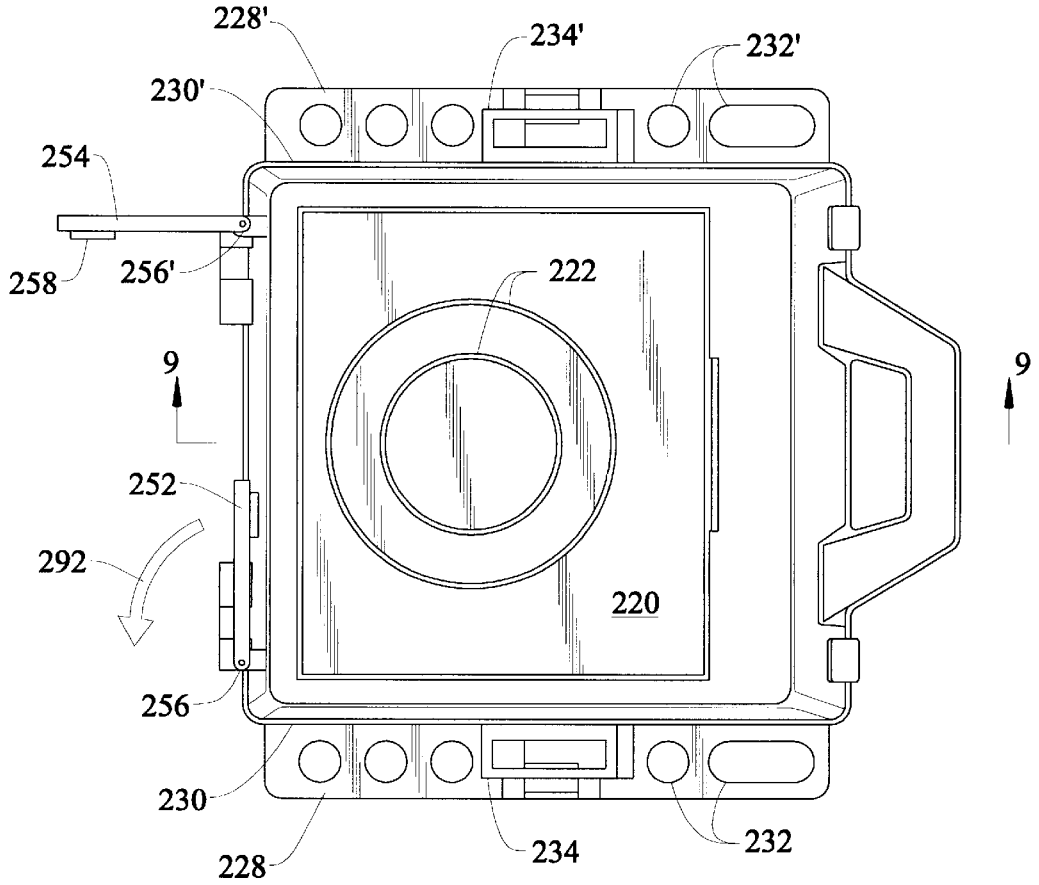
FIG. 11 is a top view of the toolbox of FIG. 10.
Figure 12:
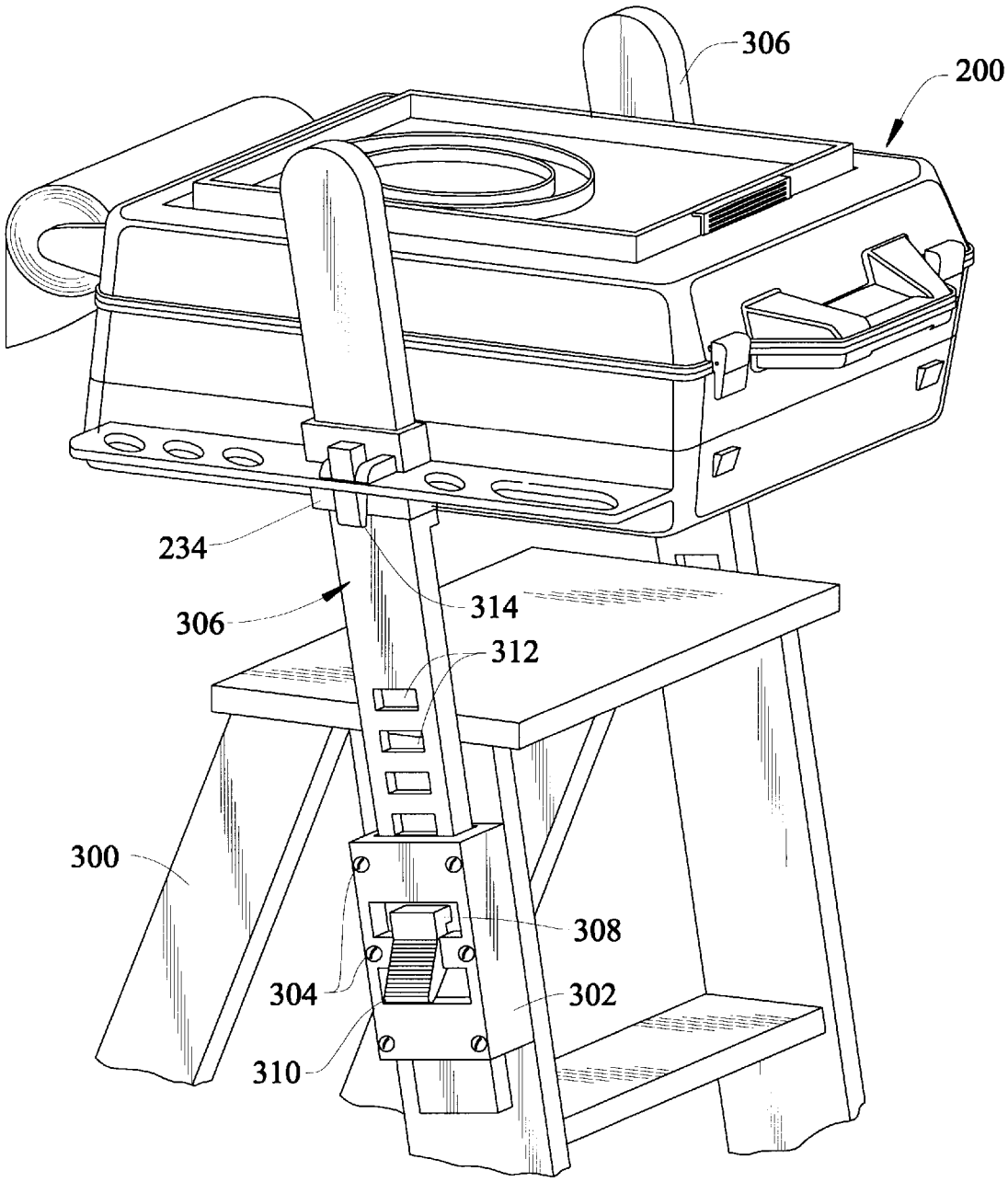
FIG. 12 is a perspective view of the toolbox of FIG. 8 as mounted on the top of a ladder on a pair of support legs.
Figure 13:
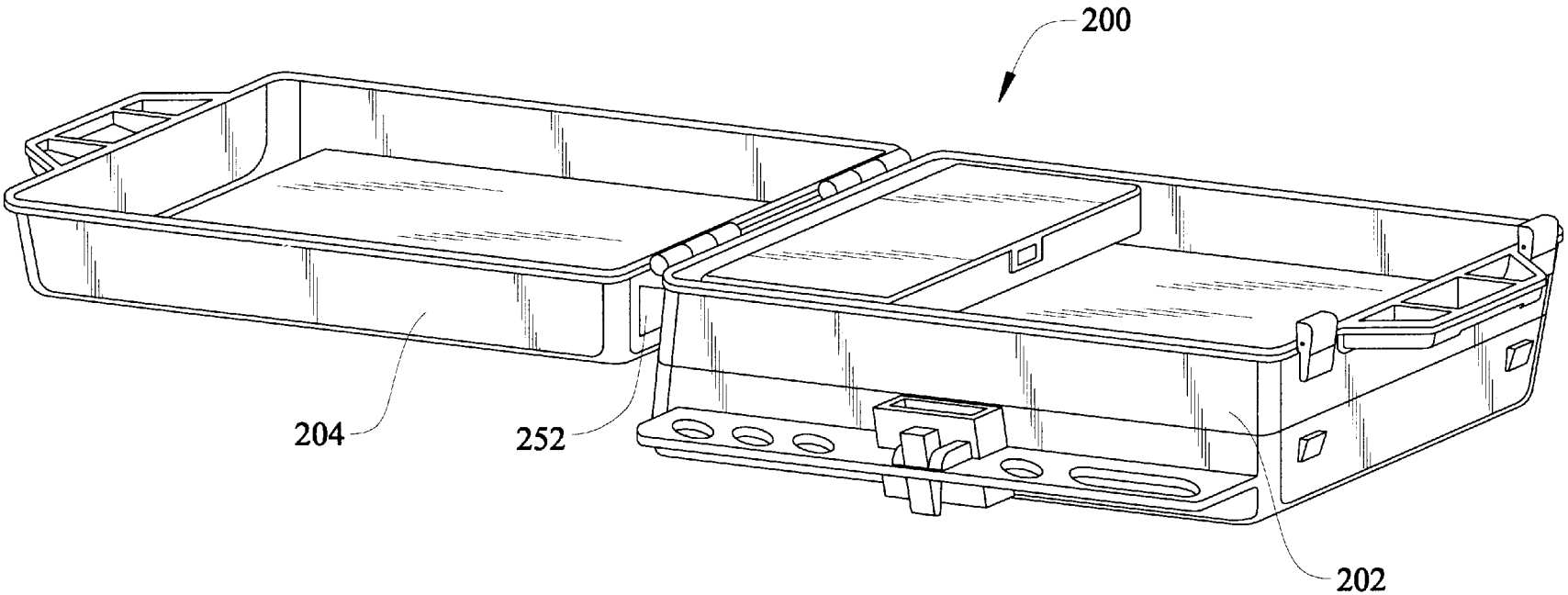
FIG. 13 is a perspective view of the toolbox of FIG. 8 with the lower tray attached and the bin cover laid open to show an inner storage tray mounted within the interior of the bin.
Figure 14:
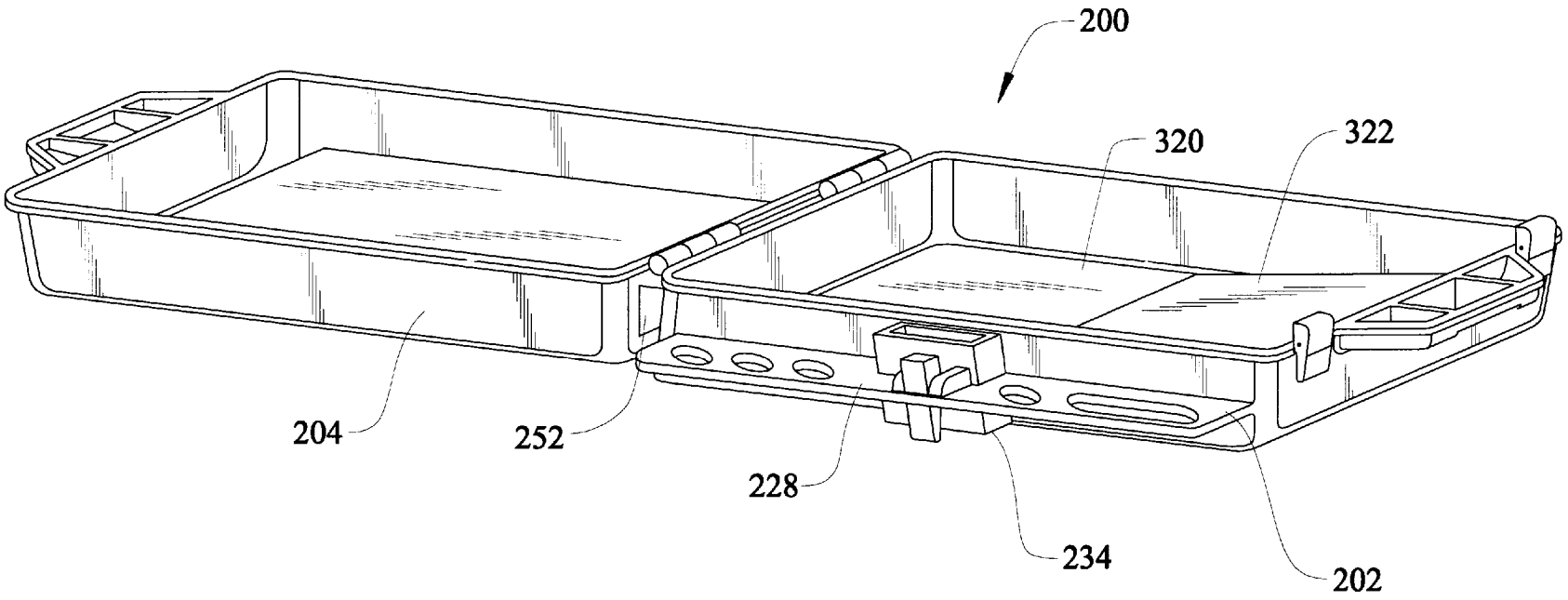
FIG. 14 is a perspective view of yet another embodiment of a toolbox which does not include a detachable storage tray mounted to the bottom surface of the bin.
Figure 15:
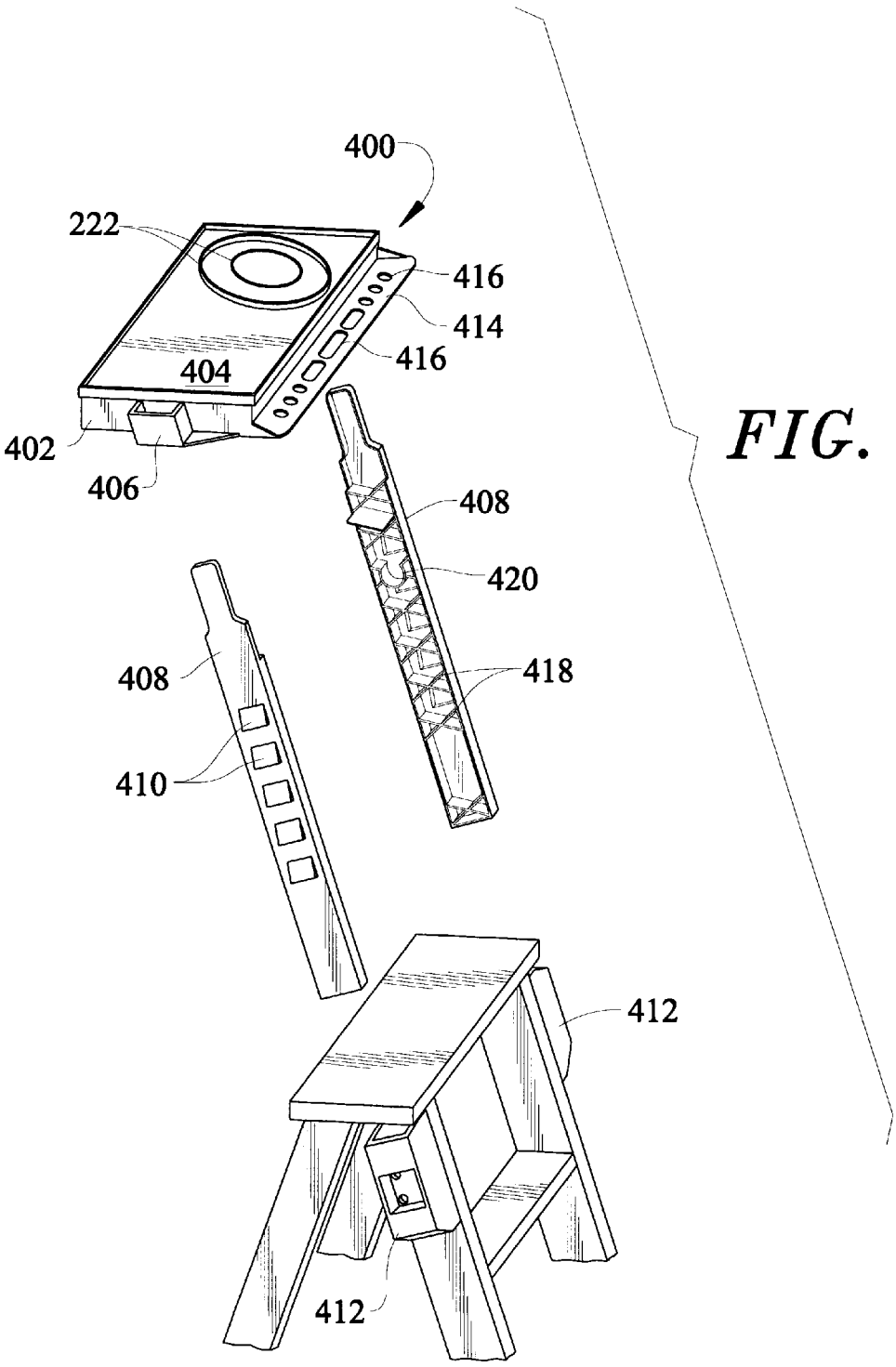
FIG. 15 is a perspective view of still another embodiment of the toolbox with the components shown exploded apart, and a elevation adjustment mechanism which includes spring loaded tabs extending from the support leg surfaces.
Figure 16:
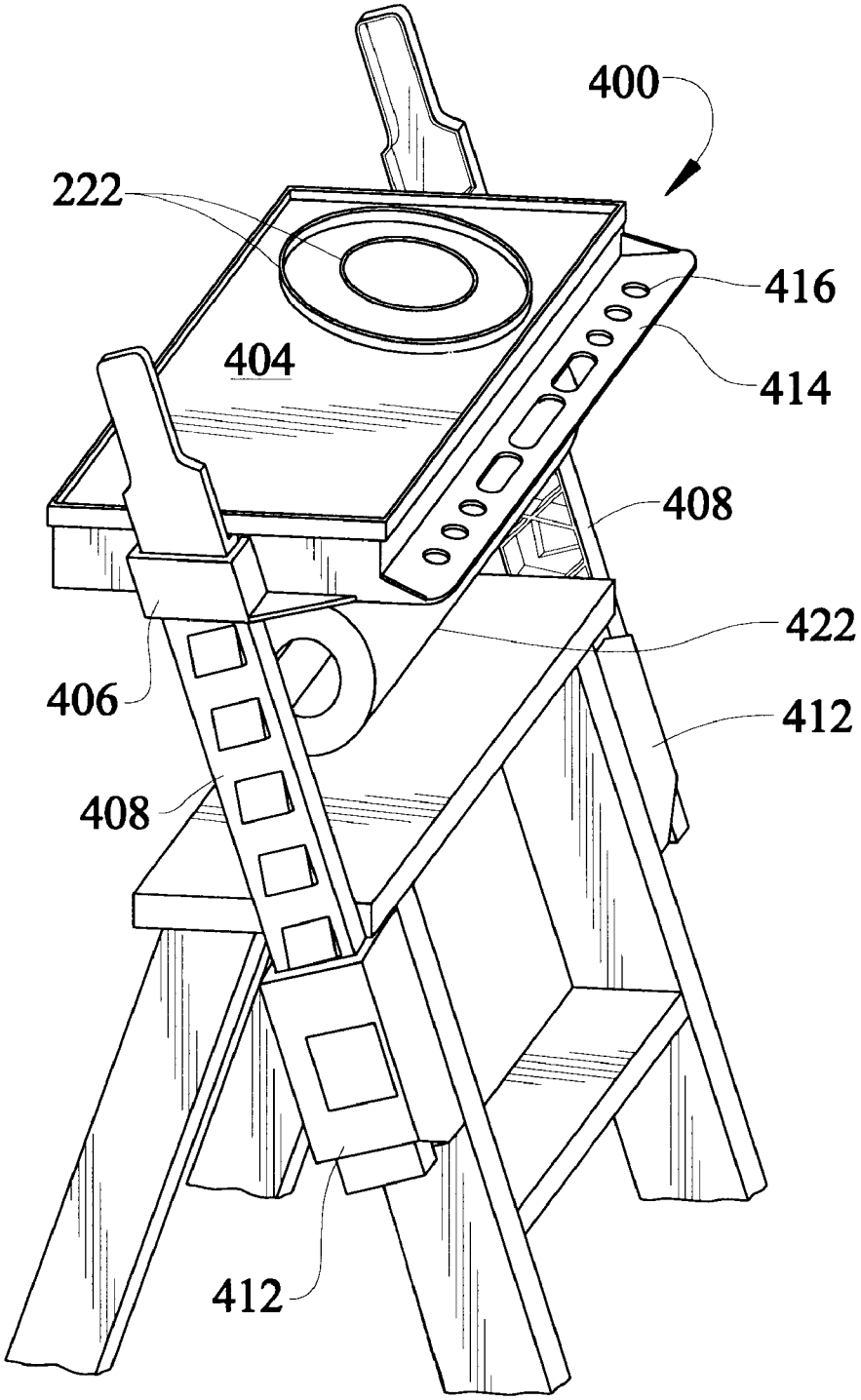
FIG. 16 is a perspective view of the embodiment of FIG. 14 with the parts assembled and a rod included between the support legs for supporting paper toweling.
Figure 17:
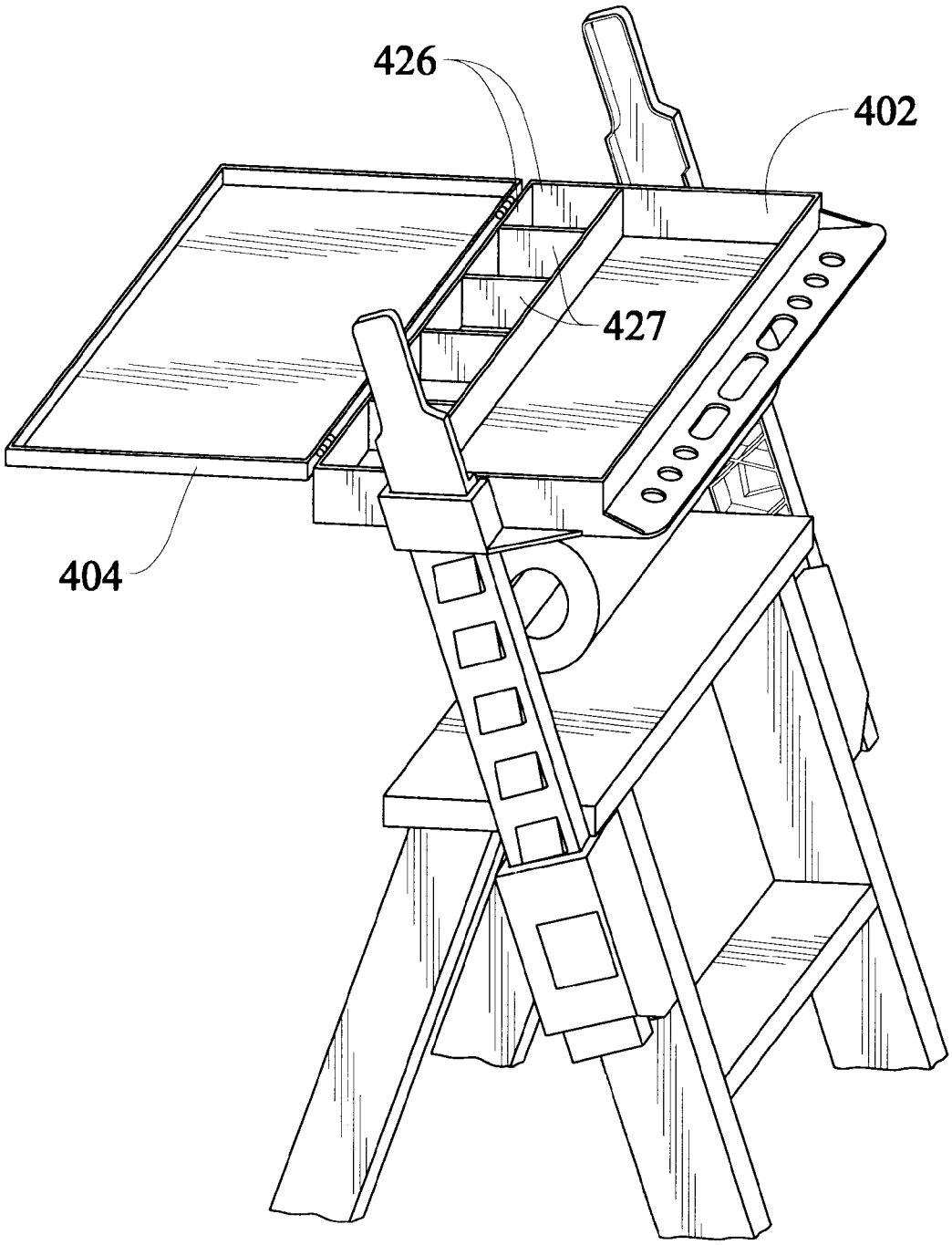
FIG. 17 is a perspective view of the embodiment of FIG. 15 with the top cover over the bin shown hingably open to show the compartmentalized interior of the bin.
Figure 27:
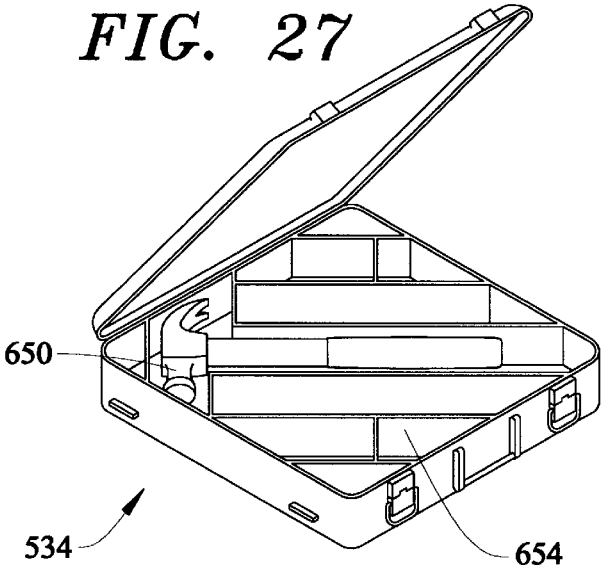
FIG. 27 is a perspective view of the toolbox in a partially opened position.
Figure 28:
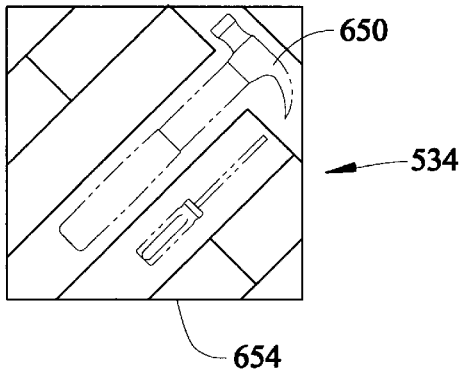
FIG. 28 is a top view of a toolbox divider section.

FIGS. 27 and 28 depict tool case 534 with the hammer 650 placed in one of the compartments 654 which further allows for the securement of miscellaneous items such as nuts and bolts, nails etc. which would assist the individual in not having to climb up and down the ladder for various tools. Each toolbox may include an assortment of tools to accomplish a particular job. For instance, an electrician may have electrical items for installing overhead lighting fixtures. A plumber may have various plumbing components for use in installing a water system. FIG. 11 further illustrates a top view of the inside of the toolbox 34 with the various compartments arranged so as to provide optimal space for storage.

Figure 29:
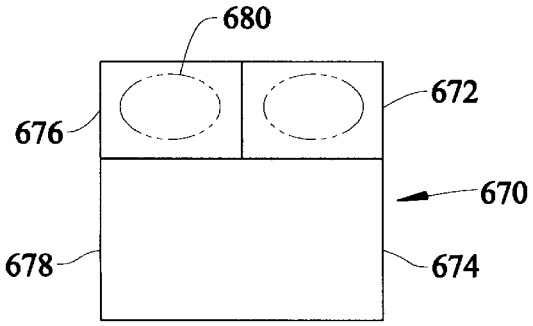
FIG. 29 is a top view of a portable storage tray.
Figure 30:
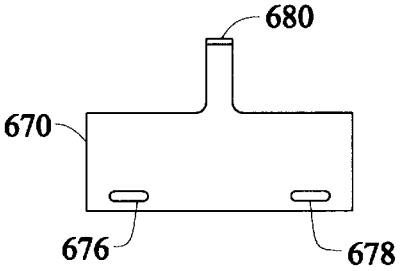
FIG. 30 is a side view of FIG. 29 without containers placed therein.

FIGS. 29 and 30 depict a tray 670 having locking tabs 672–678 for engaging the slots on the cap structure. The tray embodiment demonstrates the variety of trays that may be placed within the cap structure. In this illustration, a 32 ounce bottle may be securely placed within the tray to prevent tipping if removed from the ladder. Handle 680 allows an individual to lift a tray if necessary with tabs 676 and 678 used for engaging the cap structure.

It is to be understood that while we have illustrated and described certain forms of my invention, it is not to be limited to specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. An accessory holder for a conventional A-frame ladder comprising: a cap structure formed from a one piece rigid base having a top surface and a bottom surface, said top surface including at least one containment area, said bottom surface adapted to be positioned over an upper portion of a ladder; means for securing a portable storage container to said top surface; and a first and second strut each having a proximal end coupled to said base and a distal end securable to a ladder, said struts adapted to secure said cap structure in a fixed position to a ladder;

wherein said base includes a bracket formed integral to the bottom surface for use in securing a roll of paper towels, said base having a slot communicated from said bottom surface to said top surface sized for passage of single sheets of said paper towel roll.

2. The ladder accessory according to claim 1 wherein said proximal ends of said first and second strut are pivotablly coupled to said base.

3. The ladder accessory according to claim 1 wherein said distal ends of said struts each include a pivotedly coupled support bracket releasably positioned by an attachment strap.

4. The ladder accessory according to claim 3 wherein said attachment strap includes a hook and pile securement.

5. The ladder accessory according to claim 1 wherein said base has at least one hook member extending from a side surface.

6. The ladder accessory according to claim 1 wherein said top surface of said base has a plurality of apertures, said apertures sized for securement of miscellaneous hand tools in a vertical position.

7. The ladder accessory according to claim 1 wherein said means for securing includes opposing end walls each having at least one slotted aperture operatively associated with securement tab placed on each said storage container.

8. The ladder accessory according to claim 1 further including a storage container which is a tool box having a hinged lid for storing hand tools therein.

9. The ladder accessory according to claim 1 further including a storage container which is an open tray.

10. The ladder accessory according to claim 1 further including a storage container which is a disposable service tray.

11. The ladder accessory according to claim 1 wherein said base includes a ruler formed integral to said top surface.

12. The ladder accessory according to claim 1 including a first and second handgrip means formed integral to said base.

13. The ladder accessory according to claim 1 further including a storage container.

14. An accessory holder for a conventional A-frame ladder comprising: a cap structure formed from a one piece rigid base having a top surface and a bottom surface, said top surface including a first containment area sized for receipt of a storage container, said bottom surface adapted to be positioned over an upper portion of a ladder; a plurality of apertures formed in said top surface adjacent to said first containment area; means for securing a portable storage container to said top surface; a first and second strut each having a proximal end pivotedly coupled to said base and a distal end pivotedly coupled to a support bracket, each support bracket adapted to be releasably positioned to a support post of a ladder; and a first and second handgrip means formed integral to said base;

wherein said base includes a bracket formed integral to the bottom surface for use in securing a roll of paper towels, said base including a slot for communicating from said bottom surface to said top surface, said slot sized for passage of a single sheet of paper towel.

15. The ladder accessory according to claim 14 wherein said base has at least one hook member extending from a side surface.

16. The ladder accessory according to claim 14 wherein said means for securing is further defined as opposing end walls each having at least one slotted aperture operatively associated with securement tab placed on each said storage container.

17. The ladder accessory according to claim 14 further including a storage container which is a tool box having a hinged lid for storing hand tools therein.

18. The ladder accessory according to claim 14 further including a storage container which is an open tray.

19. The ladder accessory according to claim 14 further including a storage container which is a disposable service tray.

20. The ladder accessory according to claim 14 wherein said base includes a ruler formed integral to said top surface.

21. The ladder accessory according to claim 14 wherein pivotedly coupled support brackets are releasably positioned by an attachment strap.

22. The ladder accessory according to claim 21 wherein said attachment strap includes a hook and pile securement.

23. The ladder accessory according to claim 14 further including a storage container.

* * * * *